US011980299B2

(12) United States Patent
Spontella

(10) Patent No.: US 11,980,299 B2
(45) Date of Patent: May 14, 2024

(54) FOOTREST DEVICE FOR SOFA BEDS

(71) Applicant: ALTAFLEX S.R.L., Altamura (IT)

(72) Inventor: Nunzio Spontella, Altamura (IT)

(73) Assignee: ALTAFLEX S.R.L., Altamura (IT)

( * ) Notice: Subject to any disclaimer, the term of this patent is extended or adjusted under 35 U.S.C. 154(b) by 253 days.

(21) Appl. No.: 17/609,130

(22) PCT Filed: Nov. 19, 2019

(86) PCT No.: PCT/IB2019/060312
§ 371 (c)(1),
(2) Date: Nov. 5, 2021

(87) PCT Pub. No.: WO2020/225596
PCT Pub. Date: Nov. 12, 2020

(65) Prior Publication Data

US 2022/0218111 A1 Jul. 14, 2022

(30) Foreign Application Priority Data

May 9, 2019 (IT) ..... 2019000006588

(51) Int. Cl.

| | |
|---|---|
| ***A47C 1/035*** | (2006.01) |
| ***A47C 1/034*** | (2006.01) |
| ***A47C 1/0355*** | (2013.01) |
| ***A47C 7/50*** | (2006.01) |
| ***A47C 17/13*** | (2006.01) |

(52) U.S. Cl.
CPC ..... *A47C 7/5068* (2018.08); *A47C 1/034* (2013.01); *A47C 1/035* (2013.01); *A47C 17/13* (2013.01)

(58) Field of Classification Search
CPC ..... A47C 1/034; A47C 1/035; A47C 7/5068
USPC ..... 297/83, 84, 85 M
See application file for complete search history.

(56) References Cited

U.S. PATENT DOCUMENTS

| | | | | |
|---|---|---|---|---|
| 3,582,135 A * | 6/1971 | Fletcher | A47C 1/0355 | 297/83 |
| 3,743,348 A * | 7/1973 | Sloan | A47C 1/0345 | 297/85 M X |
| 3,937,518 A * | 2/1976 | Harrison | A47C 1/037 | 297/83 |
| 4,185,869 A * | 1/1980 | Rogers, Jr. | A47C 1/0355 | 297/84 X |

(Continued)

*Primary Examiner* — Rodney B White
(74) *Attorney, Agent, or Firm* — R. Ruschena Patent Agent, LLC

(57) ABSTRACT

A foot-lifting device for sofas, comprising: a fixed element configured to be constrained in substantially vertical position to the front portion of the structure of a sofa; a footrest which is movable with respect to the fixed element between a closed configuration and an open configuration; a connection kinematism of the footrest to the fixed element; in a closed configuration the footrest is substantially vertical, in open configuration the footrest is in rotated position upwards and translated onwards with respect to the sofa with respect to the position assumed in closed configuration, in that in both the open and closed configurations the extension of the device is wholly in front of the front portion of the structure of the sofa, and in that the kinematism comprises a chain of four articulated quadrilaterals, wherein: both the first and the second quadrilateral comprise a side integral to the fixed element.

10 Claims, 6 Drawing Sheets

(56) References Cited

U.S. PATENT DOCUMENTS

| | | | | | |
|---|---|---|---|---|---|
| 4,544,201 | A * | 10/1985 | Rogers, Jr. | A47C 3/0255 | 297/84 X |
| 5,975,627 | A * | 11/1999 | LaPointe | A47C 1/0355 | 297/83 |
| 6,000,758 | A * | 12/1999 | Schaffner | A47C 1/0345 | 297/83 X |
| 6,409,262 | B1 * | 6/2002 | LaPointe | A47C 1/0352 | 297/83 |
| 7,261,367 | B2 * | 8/2007 | Duncan | A47C 1/0352 | 297/83 X |
| 7,959,221 | B2 * | 6/2011 | Anglese | A47C 7/5068 | 297/85 R X |
| 8,070,219 | B2 * | 12/2011 | Walters | A47C 7/5068 | 297/85 R X |
| 9,326,615 | B1 * | 5/2016 | LaPointe | A47C 7/506 | |
| 11,166,562 | B2 * | 11/2021 | Zhang | A61G 5/14 | |

* cited by examiner (a)

(b)

FOOTREST DEVICE FOR SOFA BEDS

BACKGROUND OF THE INVENTION

1. Field of the Invention

The present invention relates to a mechanism useful to realize a foot-lifting device for sofas, optimized for mounting in sofa beds.

Moreover, the present invention relates to a mechanism device useful to realize a foot-lifting device for sofas, particularly optimized for mounting in sofa beds and which is provided with motorized lifting means.

Finally, the present invention relates to a sofa, and in particular a sofa bed, comprising said mechanism.

2. Brief Description of the Prior Art

At the state of the art, there are known various foot-lifting mechanisms for sofas, commercially known with the name "relax" or "Recliner". These mechanisms use substantially the movement of the back rest (on which the user acts by pushing the back, or which is activated by means of electric automatic devices) to lift a footrest, which in closed configuration is vertically arranged in the front portion of the sofa, under the seat. The weight itself of the back rest balances the weight of the footrest, and so the mechanism does not close without such an action exerted by the user.

Even though the devices known at the state of the art are mature and commercially diffused products, they cannot be applied to sofa beds. The sofa beds in fact, regardless of their specific embodiment, always comprise mechanisms positioned in the portion underlying the seat cushions. These mechanisms, which are needed for the transformation of the sofa in bed, avoid that the traditional recliner mechanisms are mounted, since the dimensions of the movement mechanism of back rest and footrest create interference with the mechanism for the transformation of the sofa in bed.

Therefore, at the state of the art the problem to provide a foot-lifting mechanism for sofas which can be applied also to sofa beds remains unsolved, and more, generally, the problem to provide a foot lifting mechanism, which can be applied to any sofa without needing any volume inside the sofa structure under the seat, remains unsolved as well. At the state of the art, it is known a foot-lifting device, described in document U.S. Pat. No. 5,695,239, in which it is shown a foot-lifting device configured to be mounted on the front portion of an armchair or sofa, and wholly extending in front of the sofa. The device shown in U.S. Pat. No. 5,695,239 comprises a footrest (26) constrained to the fixed structure of the sofa (22) by means of a first and second four-bar linkage.

Even though the device shown in U.S. Pat. No. 5,695,239 is in fact a foot-lifting device, whose dimensions are always integrally contained in the front space of the sofa, said device is yet limited, since the constraining kinematic mechanism to the front structure of the sofa (comprising two four-bar linkages) limits its possible extension onwards. Moreover, the device shown in the cited document is not provided with a motorized control, and its geometry is not such that the motorized control can be easily integrated.

In fact, the difficulty to introduce a motorized control in a foot-lifting device, whose dimensions are wholly in front of the sofa it is constrained to, is that it has to be done orthogonally to the front side of the sofa, while the thickness, possibly frontally occupied with respect to the sofa with closed footrest, has to be clearly limited.

SUMMARY OF THE INVENTION

Therefore, aim of the present invention is to provide a foot-lifting device for sofas, which can be used also with sofa beds known at the state of the art; according to another aim, the present invention provides a foot-lifting device which can be used without needing any movement of the sofa back rest; according to another aim the present invention provides a foot-lifting device for sofas, which, in no one of its configurations, extends in the portion of the sofa structure underlying the seat, so that it does not take off space for mounting the mechanisms needed for the transformation of the sofa in bed, or, however, for other uses, such for example the use as a container. As it is clear in the following, the mechanism can be applied both to sofas and armchairs of any dimension.

According to another aim, the present invention provides a foot-lifting device for sofas, which, in no one of its configurations, extends in the portion of the sofa structure underlying the seat, and in which its kinematic mechanism is also optimized for maximizing the extension onwards of the footrest, together with the rotation bringing it in substantially horizontal position.

According to another aim, the present invention provides a device which reaches the prefixed aims, and which is also provided with motorized actuation means, configured to move the mechanism between the closed configuration and the open one, wherein also the dimensions of said movement means are wholly contained, in any configuration, in the front part of the front side of the sofa seat.

Finally, the present invention provides a sofa, and in particular a sofa bed, comprising a device which reaches the just described aims.

The present invention realizes the prefixed aims since it is a foot-lifting device for sofas, comprising:

- a fixed element (0) configured to be constrained, in substantially vertical position, to the front portion of the structure (101) of a sofa (100);
- a footrest (11) which is movable with respect to said fixed element (0) between a closed configuration and an open configuration;
- a connection kinematic mechanism of said footrest (11) to said fixed element (0), characterized in that in a closed configuration said footrest (11) is substantially vertical, in open configuration said footrest (11) is in rotated position upwards and translated onwards with respect to the sofa with respect to the position assumed in closed configuration, in that in both said open and closed configurations the extension (1) of said device is wholly in front of said front portion of the structure (101) of said sofa (100), and in that said kinematic mechanism comprises a chain of four articulated quadrilaterals, wherein: both the first and the second quadrilateral comprise a side integral to said fixed element (0); the first and the second quadrilateral share a rod (1) hinged to said side integral to said fixed element (0); the third quadrilateral comprises a rod (3) integral to a rod of said first quadrilateral and a rod (7) integral to a rod of the second quadrilateral; the fourth quadrilateral comprises two rods (8, 9) integral to the rods of said third quadrilateral, not integral to rods of said first and second quadrilateral.

These and other advantages will be clear from the detailed description of the invention, which will be explained in the following with reference to the appended drawings.

BRIEF DESCRIPTION OF THE DRAWINGS

FIG. 3 shows another side view of the kinematic mechanism in open configuration, while

DETAILED DESCRIPTION OF THE PREFERRED EMBODIMENTS

Figure 1:
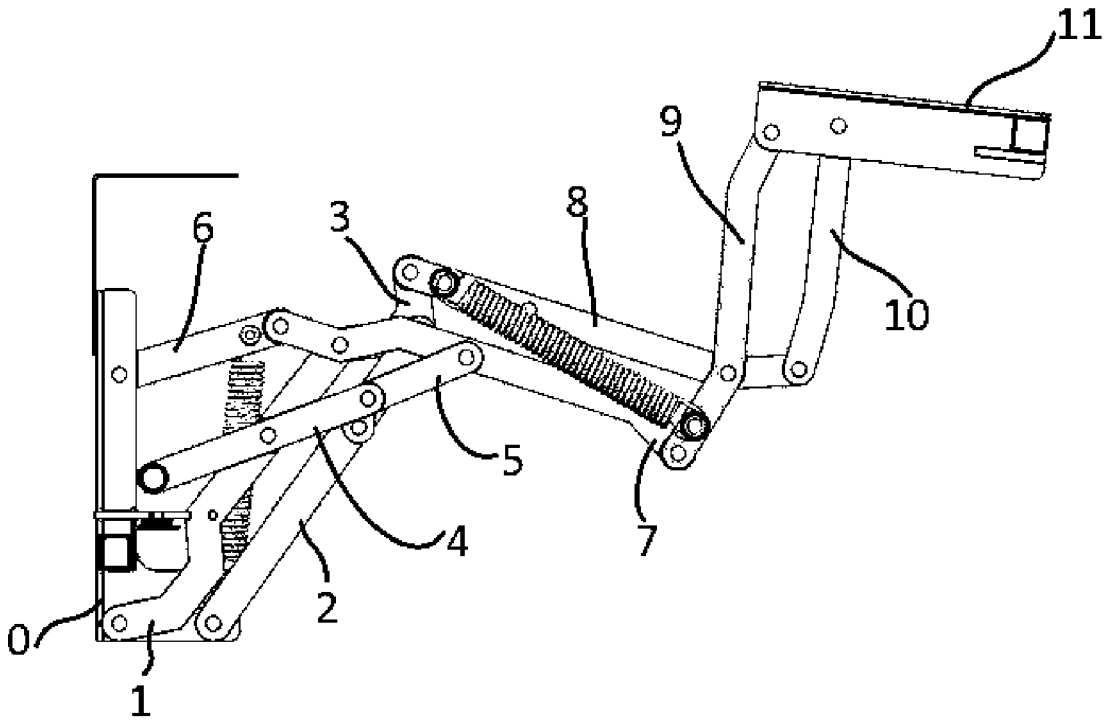
FIG. 1 shows a side view of a preferred embodiment of the kinematic mechanism in its open configuration.
Figure 2:
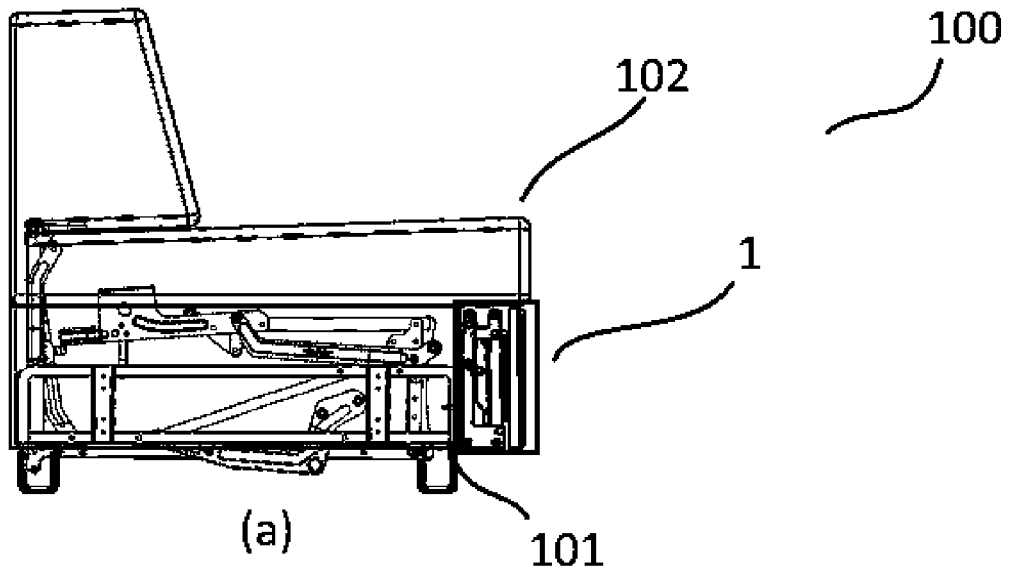
FIG. 2 shows side views of a sofa with the sofa with kinematic mechanism in closed configuration (a) and open configuration (b)
Figure 2:
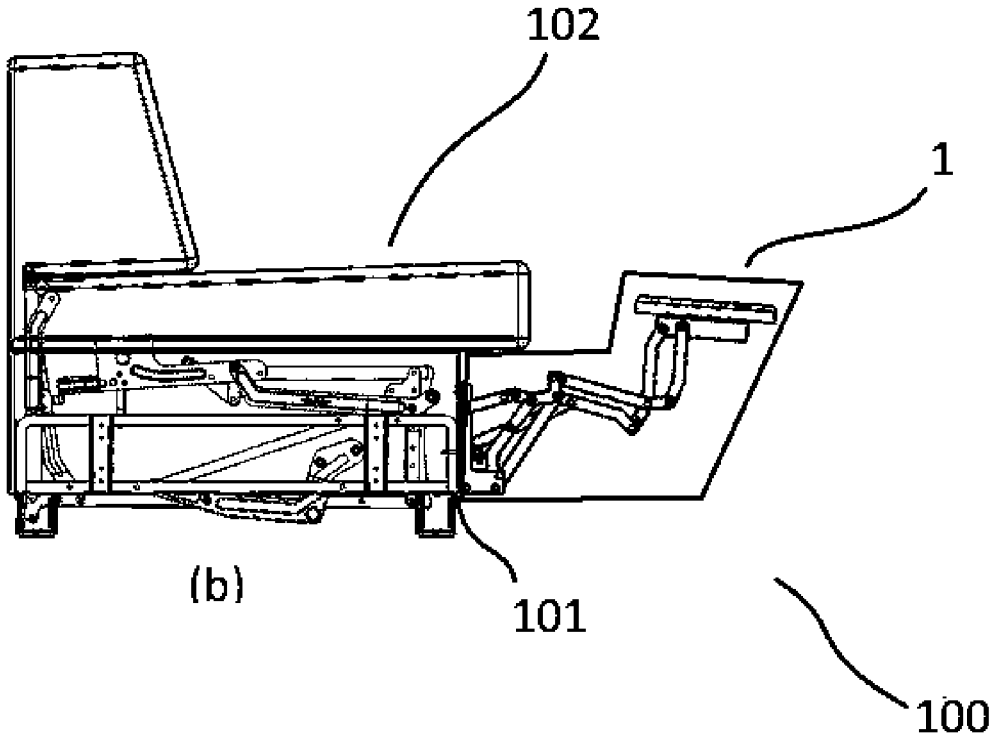

As it is shown in FIG. 1, according to a preferred embodiment the device comprises a footrest (11) constrained by means of a kinematic mechanism to a fixed element (0) integral to the structure (101) of the sofa (100) FIG. 2 shows two side views of the device, in closed configuration (a) and in open configuration (b), constrained to a sofa (100), respectively.

As it is shown in FIG. 2, in both the configurations, as well as in all the intermediate ones not drawn in FIG. 2 but shown in the following views, the extension (1) of the device is wholly in the front part of the structure (101) of the sofa (100). Obviously, the cushion (102) which makes up the seat of the sofa (100), can conveniently project frontally with respect to the structure (101) of the sofa (100), so that it covers the top of the foot-lifting device in closed configuration.

The movement mechanism, as it will be appreciated, is optimized so that the dimensions are particularly limited when it is closed. Therefore, it is not needed to increase sensibly the depth of the seat of the sofa to mount the device. In closed configuration, the footrest (11) is substantially vertical, wholly positioned under the lower edge of the seat. In open configuration, the footrest (11) is in horizontal position or slightly inclined to the horizontal, at a height equal or slightly lower than the height of the upper edge of the cushion (102) of the sofa (100), at a distance from the sofa seat compatible with its function as footrest.

Obviously, slight modifications can be made to the kinematic mechanism without departing from the aims of the invention, in order to obtain slightly different end positions of the footrest (11): more or less rotated with respect to the horizontal, more or less lowered with respect to the upper edge of the seat.

Between the first (a) and the second (b) configurations the footrest (11) is subjected to a rotation upwards of about 90°, a translation onwards and a minor translation upwards. The onwards translation is approximately but not limitingly between 30 and 60 cm.

Conveniently, moreover, the device is configured so that it is in stable balance both in open configuration (b) and closed configuration (a)) and it can pass from a configuration to the other one after an action on the coupling and uncoupling devices which can be controlled by the user.

According to another embodiment, described in detail in the following, the device can pass from one configuration to the other one by means of the action of motorized movement means.

A preferred embodiment of the device provides that the footrest (11) is constrained to the fixed element (0) integral to the structure of the sofa by means of a series of four-bar linkages. In particular, said series of four-bar linkages comprises four four-bar linkages.

Figure 4:
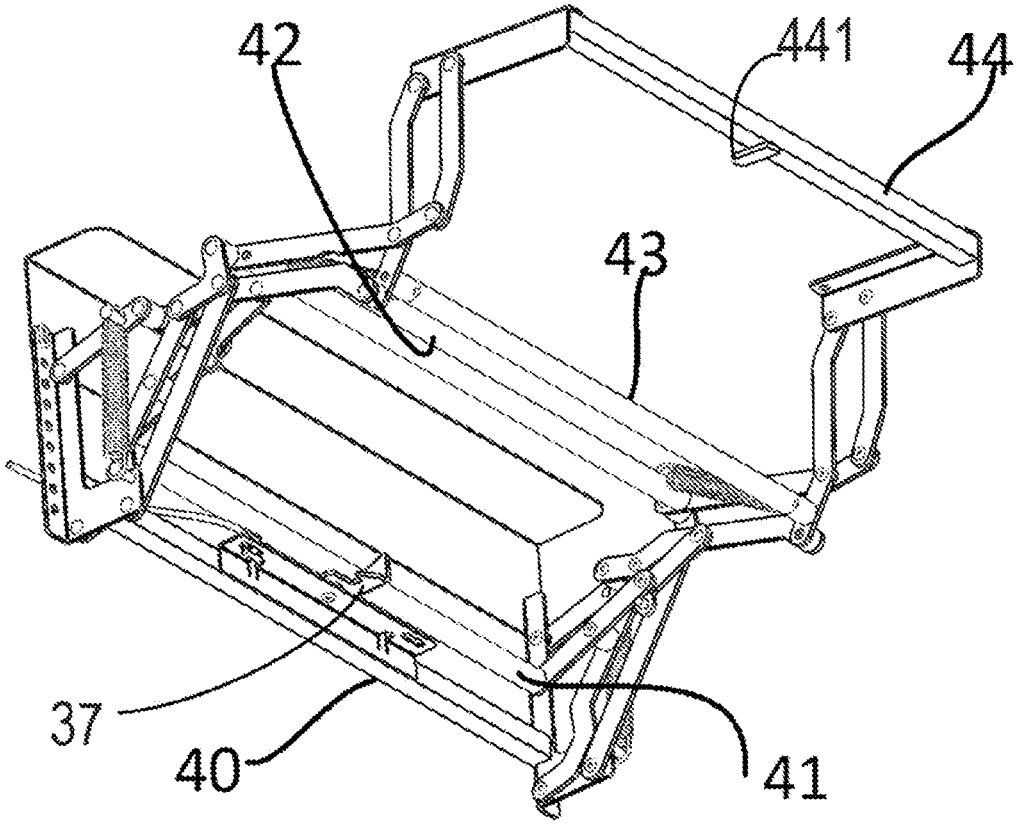
FIGS. 4 and 5 show two axonometric views of the device in open configuration, from the bottom and from the top, respectively.

In the following, the four-bar linkages are described with reference to side views. It is absolutely clear that the system comprises at least a couple of kinematic mechanisms of the described type, positioned at the ends of the sofa and configured to work in parallel to each other. It is also clear that said kinematic mechanisms are connected to each other by a plurality of tubes (40, 41, 42, 43, 44) or other stiff elements constraining corresponding points to each other of the two kinematic mechanisms, so that it is guaranteed that the configurations assumed by said kinematic mechanisms during the whole movement of said footrest are the same. This is clear from the appended FIG. 4, and from all the other axonometric views shown. These elements will be indicated, for simplicity, transversal tubes.

#1 With reference to the appended FIG. 1, the first articulated quadrilateral comprises a first (1) and a second (2) rod, whose first ends are hinged, at appropriate distance to each other, at the lower portion of said fixed element (0). Said rods (1, 2) are also hinged, at their second ends, to a third rod (3) Thus, said third rod (3) is hinged in a hinge (13) to said first rod (1), and in a second hinge to said second rod (2).

The fourth side of the quadrilateral is clearly made up of the fixed element (0) integral to the sofa structure.

Thus, the function of this first articulated quadrilateral is principally to translate onwards the remaining part of the mechanism, thus moving it away from the sofa.

#2 The second articulated quadrilateral comprises said first rod (1) hinged to the lower portion of said fixed element (0), a rod (6) hinged to the upper portion of said fixed element, and a third rod (7) hinged to the first two ones. In particular, the hinge between the third rod (7) and the first rod (1) coincides with said hinge (13) between the first (1) and the third (3) rod of the first articulated quadrilateral.

Also, in this case, the fourth side of the quadrilateral is clearly made up of the fixed element (0) integral to the sofa structure. The function of said second articulated quadrilateral is to make said third rod (7) rotate, which as it is clear in the following explanation, is pushed at the same time onwards by the third rod (3) of the first articulated quadrilateral.

Thus, the first and the second quadrilateral share a rod (1) and the position of a hinge (13), in side view.

#3 As it is clear from the drawings, the third rod (3) of the first quadrilateral and the third rod (7) of the second quadrilateral do not end in the constraining hinge (13) to the first rod (1), but are configured so that they have a range with respect to said hinge, from opposite portions with respect to the same. With reference to the appended FIG. 1, in particular, the third rod (3) of said quadrilateral has a range (31) upwards with respect to said hinge (13), the third rod (7) of said second quadrilateral has a range (71) downwards with respect to said hinge (13) It is to be specified that, if it is needed, onwards means with respect to the position of the sofa, and so, onwards displacement means that the mechanism moving away from the fixed element (0).

This configuration of the third rods (3, 7) of the first two quadrilaterals allows to realize a third articulated quadrilateral, made up of the ranges of said rods (3, 7) with respect to their own constraining points (23, 17) and of other two closing rods (8, 9) of the third quadrilaterals.

Said closing rods (8, 9) of the third quadrilateral are hinged to each other and are also hinged, respectively, to the ends of said third rods (3, 7) of the first and second articulated quadrilaterals. In turn, said rods (8, 9) of the third quadrilateral are provided with two ranges, onwards and upwards, respectively, with respect to their own relative constraining point (89).

It is to be specified that, as it is also clear from the figures, the rod (8) hinged to the upwards range (31) of the third rod (3) of the first quadrilateral is provided with an onwards range with respect to its second constraining point (89), while the rod (9) hinged to the onwards range of the third rod (7) of the second quadrilateral is provided with an upwards range with respect to its second constraining point (89) The ranges of the closing rods (8, 9) of the third quadrilateral form the fourth and last quadrilateral of the kinematic mechanism with the footrest (11) and another rod (10).

So, as a whole, the kinematic mechanism is provided with a first and a second articulated quadrilateral, which make a kinematics onwards translate and rotate, respectively, which is made up of other two articulated quadrilaterals, the first one of which (i.e. the third one of the kinematic mechanisms as a whole) is connected both to the first and the second quadrilateral. The end rod of the kinematic mechanism (11) is the rod the footrest cushion can be mounted on.

In equal terms, the kinematic mechanism is provided with a chain of four articulated quadrilaterals, which constrain a footrest (11) to the fixed structure of the sofa (0), with the following features:

- both the first and the second quadrilateral comprise a side integral to the fixed structure of the sofa (0);
- the first and the second quadrilateral share a rod (1) hinged to said side integral to the fixed structure of the sofa (0),
- the third quadrilateral has a rod (3) integral, even though not aligned, to a rod of the first quadrilateral, and a rod (7) integral and aligned to a rod of the second quadrilateral, the fourth quadrilateral has two rods (8, 9) integral to the rods of the third quadrilateral not directly hinged to the first and the second quadrilateral.

All the rods described so far are hinged to each other so that they move on parallel planes sufficiently spaced to each other so to avoid interference during the opening and closing movement of the kinematic mechanism.

In the following, the first embodiment of the device provided with manual actuation means is described.

Figure 3:
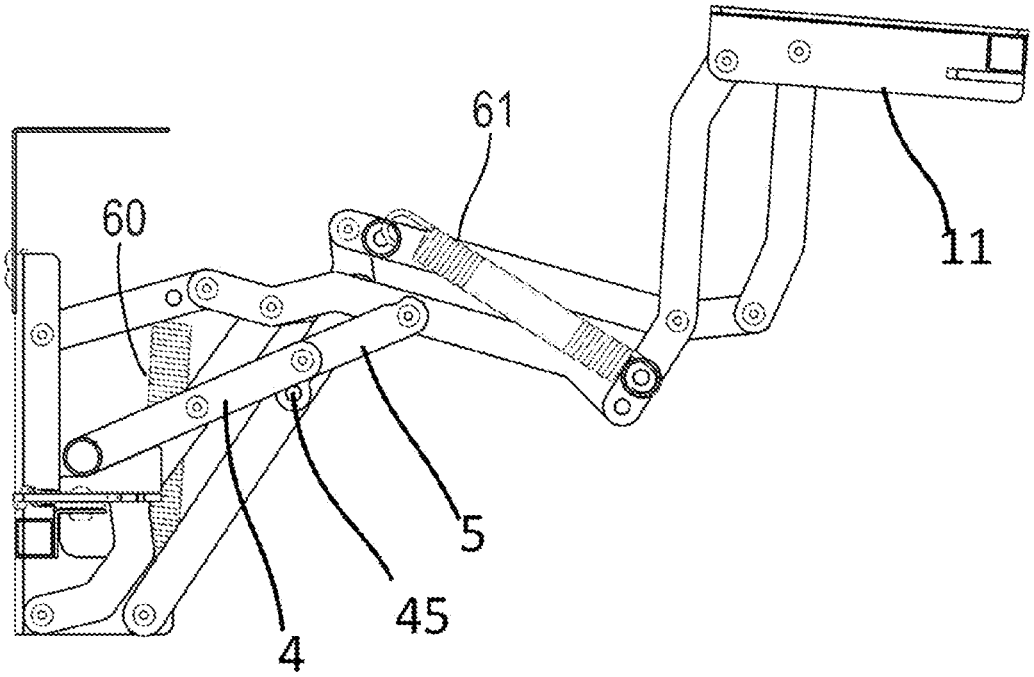

In order to guarantee that the system is balanced as a whole when it is in the open configuration, also under the weight of the user's legs, the system comprises conveniently a couple of supporting rods (4, 5), hinged to a rod (1) of the first articulated quadrilateral and to a rod (7) of the third quadrilateral, and configured to reach a parallelism to each other when the system is in the completely open position, as it is shown in FIG. 3. To one of these supporting rods (4, 5) a stop element (45) is integral, which limits the relative rotation thereof, exclusively in a direction, immediately after that the rods have reached the parallelism coming from the position in which they are in closed position, in the opening movement of the kinematic mechanism. In this position, the kinematic mechanism closing requires another relative rotation of the supporting rods (4, 5) in the direction prevented by the stop element. So, in summary, the system comprises two supporting rods (4, 5) configured to avoid that the system can be closed without an action by the user, when reached the position of open kinematic mechanism.

Figure 5:
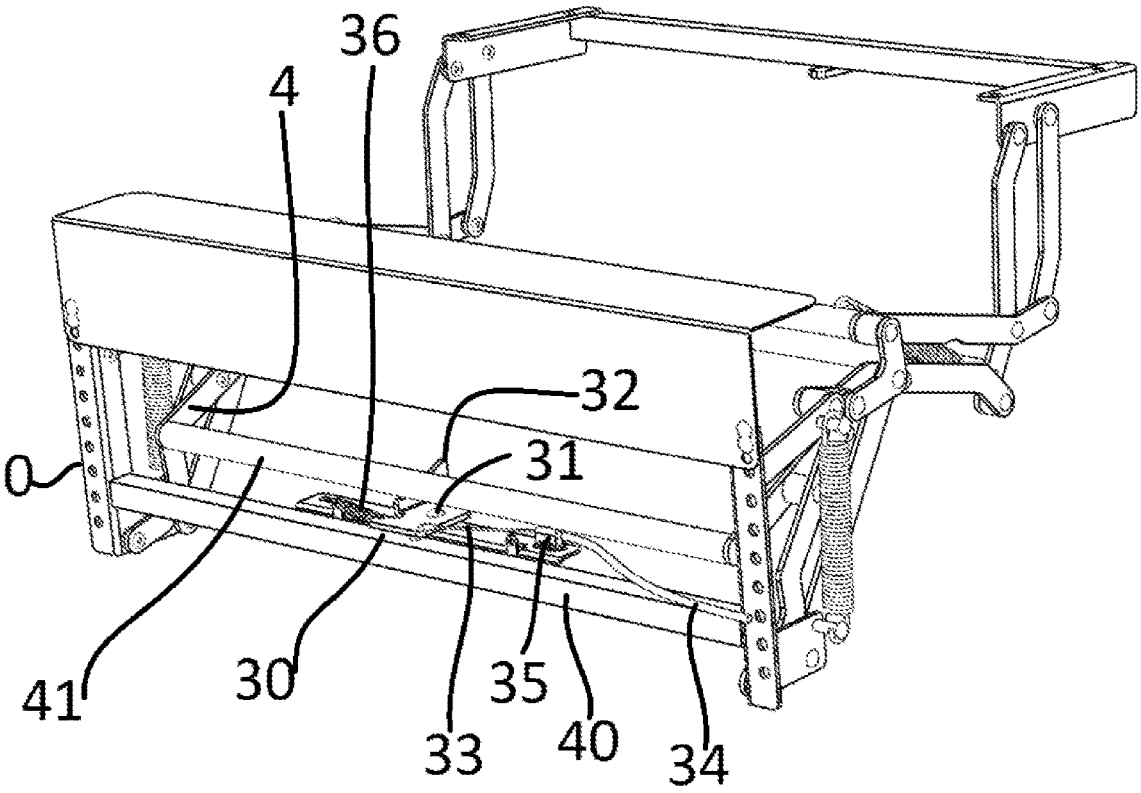

With reference to FIG. 5, the system comprises conveniently a releasing means (20) configured to make, by means of the user, one of said supporting rods (4) rotate around a point in which said rod is hinged to the kinematism kinematic mechanism, in the only direction of rotation allowed by the stop element (45), when the system is in open configuration. This rotation imposed by the user has to be sufficient to allow the two supporting rods (4, 5) to pass the configuration of perfect parallelism. In other words, the rotation imposed by the releasing system brings the two supporting rods (4, 5) back in a position in which the direction of relative rotation of the same when the kinematic mechanism closes is the one allowed by the stop element (45), and, so, the system can be closed without interference. According to a preferred embodiment, said relative rotation of the supporting rod (4) is imposed by a rotating element (30) configured to rotate around a fulcrum (31) integral to a transversal tube (40) constrained to the fixed part (0) of the kinematic mechanism. The rotating element (30) further comprises an actuator (32) configured to lift, when the kinematic mechanism is in open configuration, a transversal tube (41) integral to one of said rods (4, 5). The rotation imposed by the actuator (32) to the rod (4) brings the two supporting rods (4, 5) back in a position in which the relative rotation direction of the same, when the kinematic mechanism is closed, is the one allowed by the stop element (45).

According to a preferred, but not limiting, embodiment, the control system which allows the user to actuate the rotating element (30) comprises a flexible cable (33) which can slide in a sheath (34) constrained to a suitable block (35)— The sheath and the flexible cable, without constraints linked to rigidity, can transport the actuation position in a point easily reachable by the user while sitting on the sofa. The flexible cable (33) is constrained to the rotating element (30) so that it makes said rotating element (30) rotate and the actuator (32) actuate when pulled by the user. A return spring (36) brings the releasing element back in its rest position at the end of the user's action.

Said rotating element (30) further comprises a housing (3437) configured to engage removably a hook (441) integral to a transversal tube (44) integral to the footrest (11).

The housing (3337) and the hook (44441) are configured so that, when the system passes form the open to the closed configuration, the hook (44441) engages the housing (33) thus avoiding that the system opens again. By making the rotating element (30) rotate, according to what yet described, it is obtained the effect to disengage the hook (44441) from the housing (3337) thus allowing to open the kinematic mechanism only after an action of the user.

Conveniently, moreover, the system comprises one or more springs (60, 61) configured to exert an action such that the system is pushed in its open configuration. The springs (60, 61) balance then the weight of the footrest and other elements of the system.

It is now described, with reference to figures from 6 on, an embodiment of the device, in which the actuation is obtained by means of motorized control means, which, in the preferred version, comprise an electric motor connected to the kinematic mechanism, as it is described in the following.

Figure 6:
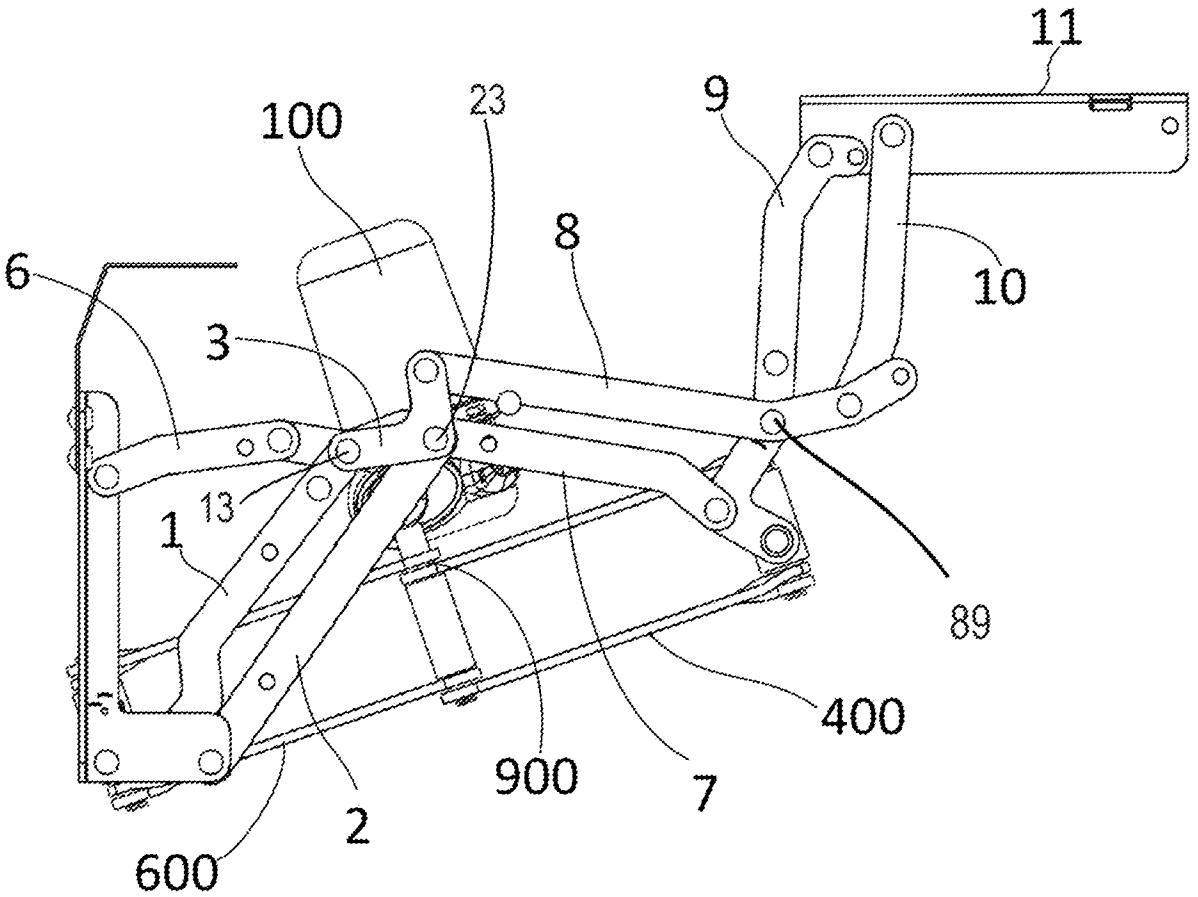
FIGS. 6 and 7 are a side views of this embodiment are shown, in closed and open configuration, respecitvely.
Figure 7:
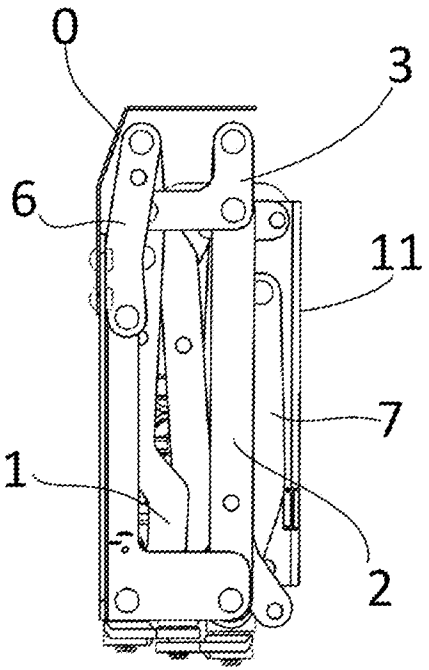

In FIGS. 6 and 7, side views of this embodiment are shown, in closed and open configuration, respectively. In particular, with reference to FIG. 7, with the same numbers are indicated the rods with the same function as the mechanism provided with manual actuation means. As, it can be observed the kinematic mechanism is identical to the just described one, except for the fact that it is not needed the provision of block supporting rods (4, 5), since the motor and relative coupling kinematic mechanism act as block means themselves, not only in the closed and open configuration, but also in any intermediate configuration assumed by the kinematic mechanism.

Figure 8:
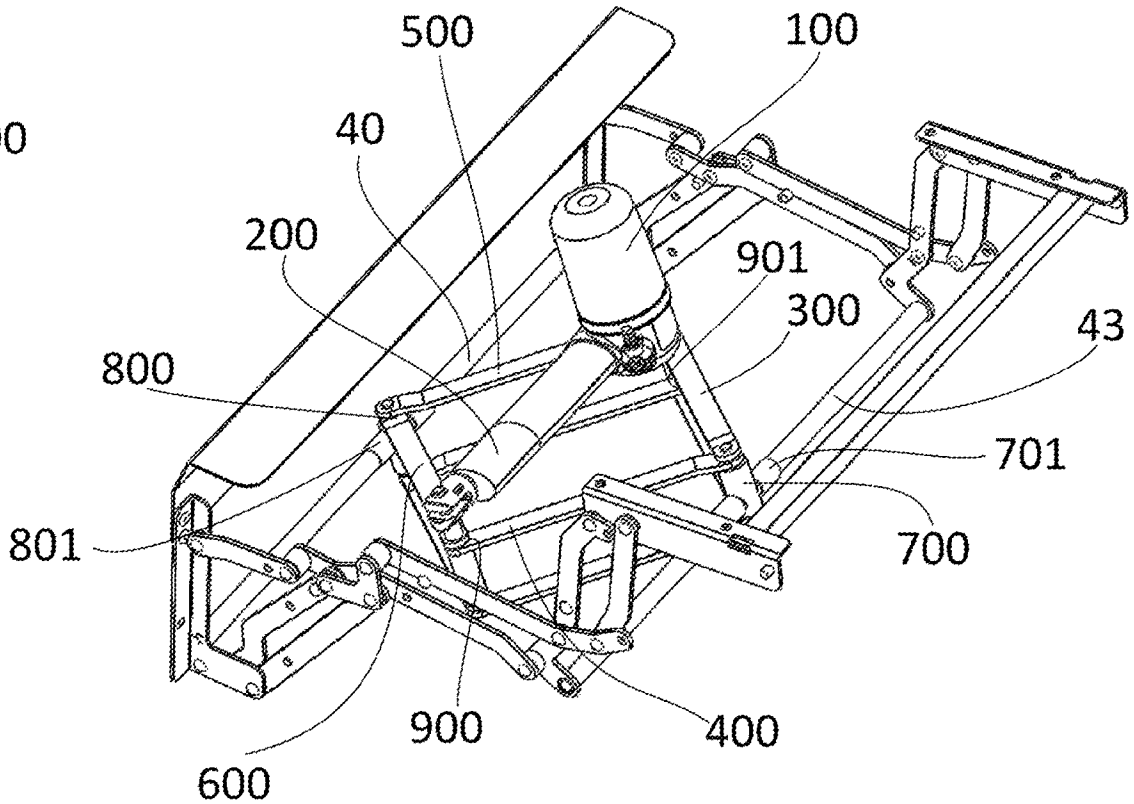
FIGS. 8, 9 show views of an embodiment of the device equipped with an actuator driven by an electric motor.
Figure 9:
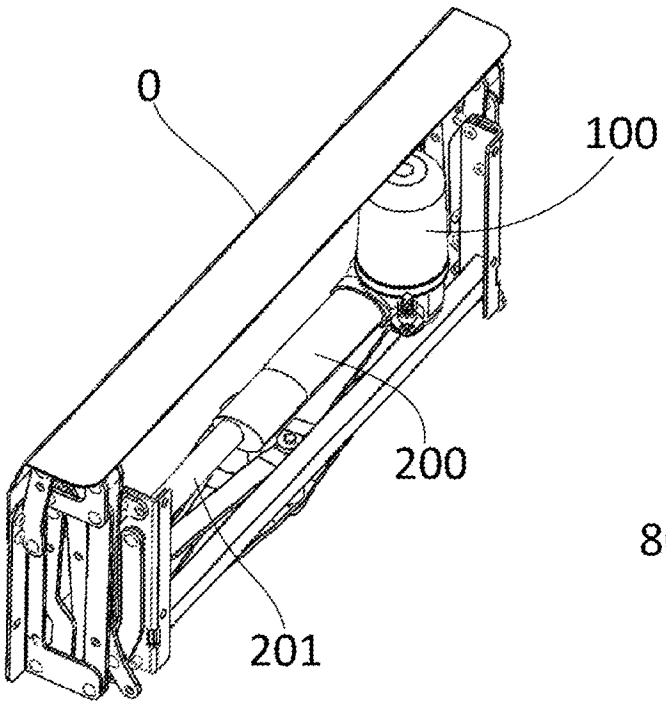

FIGS. 8 and 9 show isometric views in closed and open configuration of the device.

As it is shown in FIG. 9, in this embodiment, the device comprises an electric motor (100) configured to actuate a linear actuator (200) provided with a telescopic knot (201). The linear actuator (200) is arranged in parallel direction to the front surface of the sofa, which, as it is clear, coincides with the longitudinal development direction of the foot lifting device and so it is parallel to the direction of the transversal tubes. It is to be specified that, even though the electric motor (100) shown in figure represents a preferred embodiment, instead of the electric motor a gas spring, a traction spring or other device can be used, which is able to actuate said linear actuator (200).

The linear actuator (200) acts by means of a telescopic knot (201) on a pantograph mechanism comprising four rods (300, 400, 500, 600) hinged to each other to form an articulated quadrilateral.

Two opposite hinges (900, 901) of said pantograph are integral to the ends of said linear actuator (200); a third hinge (800) of said pantograph is constrained to a transversal tube (40) integral to the fixed portion (0) of the device; a fourth hinge (700) is integral to a transversal tube (43) integral to the last quadrilateral of said series of articulated quadrilaterals which controls the movement of the footrest.

Said transversal tubes (40, 43) have circular section, and said hinges (700, 900) are constrained to said tubes so that they can rotate with respect to the same. FIG. 8 shows the use of coaxial tubes (701, 801) for connecting the hinges to the transversal tubes, but other constraining means with equal function can be used without departing from the aims of the invention.

Yet, it is to be specified that in FIG. 8, it is shown a pantograph provided with two equal elements for each rod constituting it. It is clear that, a different structure, for example with only one element to realize each side of the pantograph can be used without departing from the aims of the invention.

After describing the elements of the kinematic mechanism, the functioning of the motorized control means can be described now.

When the motor (100) controls the linear actuator (200) to make the telescopic element (201) go out, the two opposite hinges of the pantograph (900, 901) integral to the linear actuator have to be clearly spaced apart reciprocally. As a consequence, the other two hinges (700, 800) of the pantograph integral to the fixed portion (0) of the device and the last articulated quadrilateral have to be approached to each other, up to bring the system in the closed configuration shown in FIG. 9.

In contrast, when the motor (100) controls the linear actuator (200) to make the telescopic element (201) go in again, the two opposite hinges of the pantograph (900, 901) integral to the linear actuator (200) have to be clearly approached to each other. As a consequence, the other two hinges (700, 800) of the pantograph integral to the fixed portion (0) of the device and to the last articulated quadrilateral have to be spaced apart from each other, up to bring the system in the open configuration shown in FIG. 9.

It is to be observed that, as it is clear in particular from FIG. 6, the plane in which the pantograph works rotates with respect to the horizontal during the opening and closing movement, since the last quadrilateral moves not only onwards but also upwards in its movement.

In light of the functioning of the system it is clear that it is sufficient to have a not reversible type motor-linear actuator group (i.e. in which the linear actuator (200) cannot be actuated by an outer action on the pantograph) to obtain the possibility to block the device in any configuration, and not only in the completely closed one o completely open one.

Moreover, it is clear that the device is provided with control means for said electric motor and with connecting means to the electric network of the type known at the state of the art, not described for brevity.

The invention claimed is:

1. A foot-lifting device for sofas comprising:

a fixed element (0) configured to be constrained in a substantially vertical position to a front portion of a structure (101) of a sofa (100);

a footrest (11) which is movable with respect to said fixed element (0) between a closed configuration and an open configuration;

two kinematic mechanisms connecting said footrest (11) to said fixed element (0); and wherein in a closed configuration said footrest (11) is substantially vertical, in the open configuration said footrest (11) is in an upwards rotated position and translated forward with respect to a position of the closed configuration; and wherein in both said open and closed configurations, an extension (1) of said device is wholly in front of the structure (101) of said sofa (100), and wherein each kinematic mechanism comprises a chain of four articulated quadrilaterals: a first quadrilateral, a second quadrilateral, a third quadrilateral and a fourth quadrilateral, said four quadrilaterals comprise:

a first rod (1), a second rod (2), a third rod (3), a fourth rod (4)

a fifth rod (5), a sixth rod (6), a seventh rod (7), a eighth rod (8), a ninth rod (9), a tenth rod (10);

wherein the first quadrilateral comprises:

the first rod (1), the second rod (2), both connected to the third rod (3) at a hinge (13), both the first rod (1) and the second rod (2) are anchored to the fixed element (0);

the second quadrilateral comprises:

the first rod (1) hinged to said fixed element (0) and to the seventh rod (7) at said hinge (13), which is connected to the sixth rod (6) anchored to the fixed element (0);

the third quadrilateral comprises:

the seventh rod (7) connected to the ninth rod (9), which is connected to the eighth rod (8) which is connected to the third rod (3);

the fourth quadrilateral comprises:

the ninth rod (9) connected to a footrest (11), the tenth rod (10) connected to the footrest (11), the eighth rod (8) connected to both the ninth rod (9) and the tenth rod (10); and wherein both the first and the second articulated quadrilaterals share the first rod (1) hinged to said fixed element (0).

2. The foot-lifting device for sofas according to claim 1, wherein each of said kinematic mechanisms comprise a chain of four articulated quadrilaterals, said kinematic mechanisms being connected to each other by a plurality of tubes (40, 41, 42, 43, 44) which are stiff elements constraining corresponding points to each of said kinematic mechanisms, so that it is guaranteed that configurations assumed by said kinematic mechanisms are the same during a deployment of said footrest from a closed to an open position.

3. The foot-lifting device for sofas according to claim 1, further comprising a linear actuator (200) arranged in parallel direction of said foot-lifting device and being configured to deploy, by means of a pantograph mechanism, said kinematic mechanisms to translate the footrest (11) from a closed to an open position and vice-versa.

4. The foot-lifting device for sofas according to claim 3, further comprising an electric motor (100) configured to operate said linear actuator (200).

5. The foot-lifting device for sofas according to claim 3, wherein said pantograph mechanism comprises four rods (300, 400, 500, 600) hinged to each other to form said pantograph mechanism, wherein two opposite hinges (900, 901) of said pantograph mechanism are integral to ends of said linear actuator (200), a third hinge (800) of said pantograph mechanism being constrained to a first transversal tube (40) integral to the fixed element (0) of the device, and a fourth hinge (700) being integral to a second transversal tube (43) attached to the third quadrilateral at said ninth rod (9) connected to said chain of four articulated quadrilaterals.

6. The foot-lifting device for sofas according to claim 5, wherein said first and second transversal tubes (40, 43) have a circular section, and said fourth hinge (700) and one of said two opposite hinges (900) are constrained to said first and second transversal tubes (40, 43) so that said first and second transversal tubes (40, 43) rotate around first and second axes, respectively.

7. A sofa comprising a foot-lifting device according to claim 1.

8. The sofa according to claim 7, wherein said sofa is a sofa bed.

9. The foot-lifting device for sofas according to claim 1, further comprising:

springs (60, 61), configured to exert an action to allow the foot-lifting device to be pushed to said open configuration.

10. The foot-lifting device for sofas according to claim 1, further comprising:

a stop element (45);

wherein said fourth and fifth rods (4, 5) are supporting a weight of a user's legs, when the kinematic mechanism is in an open configuration; and wherein said fourth and fifth rods (4, 5) are further configured in conjunction with the stop element (45) to prevent the kinematic mechanism from being closed without an action by a user.

* * * * *